US012342874B2

(12) United States Patent
Lin et al.

(10) Patent No.: US 12,342,874 B2
(45) Date of Patent: Jul. 1, 2025

(54) BRASSIERE

(71) Applicant: Shenzhen Lute Jiacheng Supply Chain Management Co., Ltd., Shenzhen (CN)

(72) Inventors: Jiehua Lin, Shenzhen (CN); Qian Feng, Shenzhen (CN)

(73) Assignee: Shenzhen Lute Jiacheng Supply Chain Management Co., Ltd., Shenzhen (CN)

( * ) Notice: Subject to any disclaimer, the term of this patent is extended or adjusted under 35 U.S.C. 154(b) by 7 days.

(21) Appl. No.: 18/504,423

(22) Filed: Nov. 8, 2023

(65) Prior Publication Data

US 2025/0120454 A1 Apr. 17, 2025

(30) Foreign Application Priority Data

Oct. 13, 2023 (CN) ..... 202322780871.7

(51) Int. Cl.
*A41C 3/00* (2006.01)

(52) U.S. Cl.
CPC ..... *A41C 3/0007* (2013.01)

(58) Field of Classification Search
None
See application file for complete search history.

(56) References Cited

U.S. PATENT DOCUMENTS

| | | | | |
|---|---|---|---|---|
| 5,967,877 | A * | 10/1999 | Howard | A41C 3/0007 450/53 |
| 6,406,351 | B1 * | 6/2002 | Chen | A41C 3/142 450/55 |
| 6,966,815 | B2 * | 11/2005 | Weinerth | A41C 3/10 450/39 |
| 7,604,526 | B2 * | 10/2009 | Liu | A41C 3/122 450/39 |
| 8,221,189 | B2 * | 7/2012 | Chen | A41C 3/065 450/88 |
| 9,320,305 | B1 * | 4/2016 | Berger | A41C 3/08 |
| 10,123,575 | B2 * | 11/2018 | Funk-Danielson | A41C 3/0057 |
| 10,660,377 | B2 * | 5/2020 | Randall | A41C 3/14 |
| 11,172,711 | B2 * | 11/2021 | Randall | A41C 3/02 |
| 2002/0022432 | A1 * | 2/2002 | Magrone | A41C 3/10 450/41 |
| 2003/0232571 | A1 * | 12/2003 | Weinerth | A41C 5/00 450/41 |
| 2007/0298681 | A1 * | 12/2007 | Liu | A41C 3/122 450/39 |

(Continued)

*Primary Examiner* — Jocelyn Bravo
(74) *Attorney, Agent, or Firm* — Westbridge IP LLC

(57) ABSTRACT

Disclosed is a brassiere. The brassiere includes a bra cup and a lower supportive component. The bra cup includes a first connection part configured to connect to the lower supportive component, the lower supportive component includes a second connection part configured to connect to the bra cup, and the first connection part and the second connection part are stacked and connected. The first connection part is embedded with a soft reinforcement strip; the second connection part is embedded with the soft reinforcement strip; or the soft reinforcement strip is provided between the first connection part and the second connection part. The toughness of the soft reinforcing strip is higher than the toughness of the bra cup and the toughness of other parts of the lower supportive component.

6 Claims, 3 Drawing Sheets

(56) References Cited

U.S. PATENT DOCUMENTS

| | | | | |
|---|---|---|---|---|
| 2010/0015886 | A1* | 1/2010 | Waitz | A41C 3/10<br>450/86 |
| 2017/0360118 | A1* | 12/2017 | Randall | A41C 3/02 |
| 2018/0070653 | A1* | 3/2018 | Montford | A41C 3/0014 |
| 2019/0021406 | A1* | 1/2019 | Funk-Danielson | A41C 3/0057 |
| 2020/0022423 | A1* | 1/2020 | Webster | A41C 3/144 |

* cited by examiner

BRASSIERE

CROSS-REFERENCE TO RELATED APPLICATIONS

The present application claims priority to Chinese Patent Application No. 202322780871.7, filed on Oct. 13, 2023, the entire contents of which are incorporated herein by reference.

TECHNICAL FIELD

The present application relates to the technical field of brassieres, in particular to a brassiere.

BACKGROUND

Wire-free bras are favored by the majority of female consumers because of their soft feel and comfortable wearing. Since the existing wire-free bras have better comfort by simply canceling the wire rings and having no replacement structure, these bras do not support the breasts very well. The position near the lower supportive component of the bra has poor load-bearing performance and poor comfort and fit, which can easily cause the adverse consequences of breast sagging and deformation, affecting physical health.

SUMMARY

The main objective of the present application is to provide a brassiere, aiming to solve the problem of poor load-bearing performance of existing wire-free bras.

In order to achieve the aforementioned objective, the present application provides a brassiere, including a bra cup, and a lower supportive component.

The bra cup includes a first connection part connected to the lower supportive component, and the lower supportive component includes a second connection part connected to the bra cup; the first connection part and the second connection part are stacked and connected; and the first connection part is embedded with a soft reinforcement strip; or the second connection part is embedded with the soft reinforcement strip; or the soft reinforcement strip is provided between the first connection part and the second connection part, and a toughness of the soft reinforcing strip is higher than a toughness of the bra cup and a toughness of other parts of the lower supportive component.

In some embodiments, the soft reinforcement strip is bonded through a gluing process.

In some embodiments, the second connection part is embedded with the soft reinforcement strip, and the soft reinforcement strip is provided on an inside layer of the lower supportive component.

In some embodiments, the lower supportive component includes an outer layer, the soft reinforcement strip and an inner layer which are stacked in sequence from an outside to an inside.

In some embodiments, the lower supportive component further includes a soft reinforcement layer located on the inside layer of the lower supportive component, and the outer layer, the soft reinforcement strip, the soft reinforcement layer and the inner layer are stacked in sequence.

In some embodiments, the outer layer and the soft reinforcement layer are bonded through the gluing process, the soft reinforcement strip is fixed between the outer layer and the soft reinforcement layer, and the soft reinforcement layer and the inner layer are bonded through the gluing process.

In some embodiments, the soft reinforcement strip is a fabric strip formed by laminating polyester filament, draw texturing yarn and polyester filament in sequence; and the soft reinforcement layer is a fabric piece formed by laminating polyester filament, draw texturing yarn and polyester filament in sequence.

In some embodiments, an end of the outer layer is configured to extend towards the inner layer and fixedly connect to an end of the inner layer to wrap the soft reinforcement strip and the soft reinforcement layer.

In some embodiments, the bra cup includes a first fabric layer, a cup surface layer and a second fabric layer which are stacked in sequence form an outside to an inside, and an outer side of the first fabric layer and an inner side of the lower supportive component are stacked together.

In some embodiments, the second fabric layer and the inner side of the lower supportive component are bonded through the gluing process, the first fabric layer and the second fabric layer are bonded through the gluing process, and the cup surface layer is fixed between the first fabric layer and the second fabric layer.

Compared with the existing technology, the bra provided by the present application has the following beneficial effects.

In the technical solution of the present application, the soft reinforcement strip is embedded, and the toughness of the soft reinforcement strip is higher than the toughness of the bra cup and the toughness of other parts of the lower supportive component, thereby providing good support. The embedded soft reinforcement strip can enhance the elasticity of the lower supportive component and support the breasts very well to reduce sagging and deformation of the breasts. In addition, the soft reinforcement strip fits well with the lower edge of the human breasts and provide good comfort.

BRIEF DESCRIPTION OF THE DRAWINGS

In order to more clearly illustrate the technical solutions in the embodiments of the present application or in the related art, drawings in the embodiments or in the related art will be briefly described below. Obviously, the drawings in the following description are only some embodiments of the present application. Other drawings can be obtained by those skilled in the art according to the structures shown in the drawings without creative work.

Figure 1:
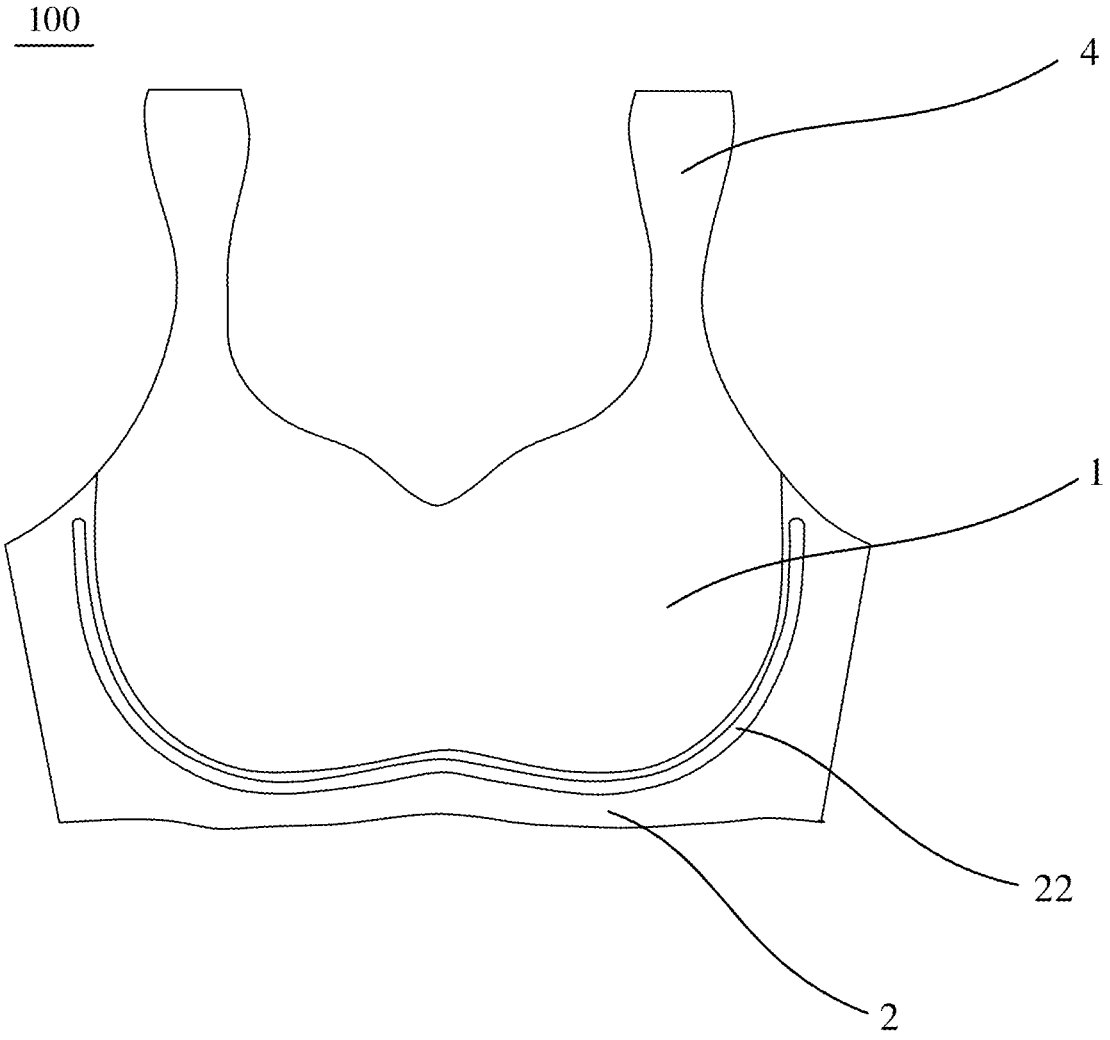
FIG. 1 is a schematic structural view of a brassiere according to some embodiments of the present application.

The realization of the purpose, functional characteristics and advantages of the present application will be further described with reference to the attached drawings in combination with embodiments.

DETAILED DESCRIPTION OF THE EMBODIMENTS

The technical solutions of embodiments of the present application will be clearly and completely described with reference to the drawings of the present application. Obviously, the described embodiments are only some rather than all of the embodiments of the present application. Based on the embodiments of the present application, all other embodiments obtained by those skilled in the art without creative efforts shall fall within the scope of the present application.

It should be noted that all directional indicators (such as up, down, left, right, front, rear, etc.) in the embodiments of the present application are only used to explain the relative positional relationship, movement situation, etc. among components in a specific attitude (as shown in the drawings). If the specific attitude changes, the directional indication also changes accordingly.

In addition, the descriptions related to "first", "second" and the like in the present application are merely for descriptive purposes, and should not be understood as indicating or implying their relative importance or implicitly indicating the number of technical features indicated. Therefore, the features defined by "first" and "second" may explicitly or implicitly include at least one such feature. Besides, the meaning of "and/or" appearing in the whole text is the same, and it means to include three parallel plans, taking "A and/or B as an example", including plan A, or plan B, or plan A and B. Besides, the various embodiments can be combined with each other, but the combination must be based on what can be achieved by those skilled in the art. When the combination of the embodiments is contradictory or cannot be achieved, it should be considered that such combination does not exist, or is not within the scope of the present application.

Figure 2:
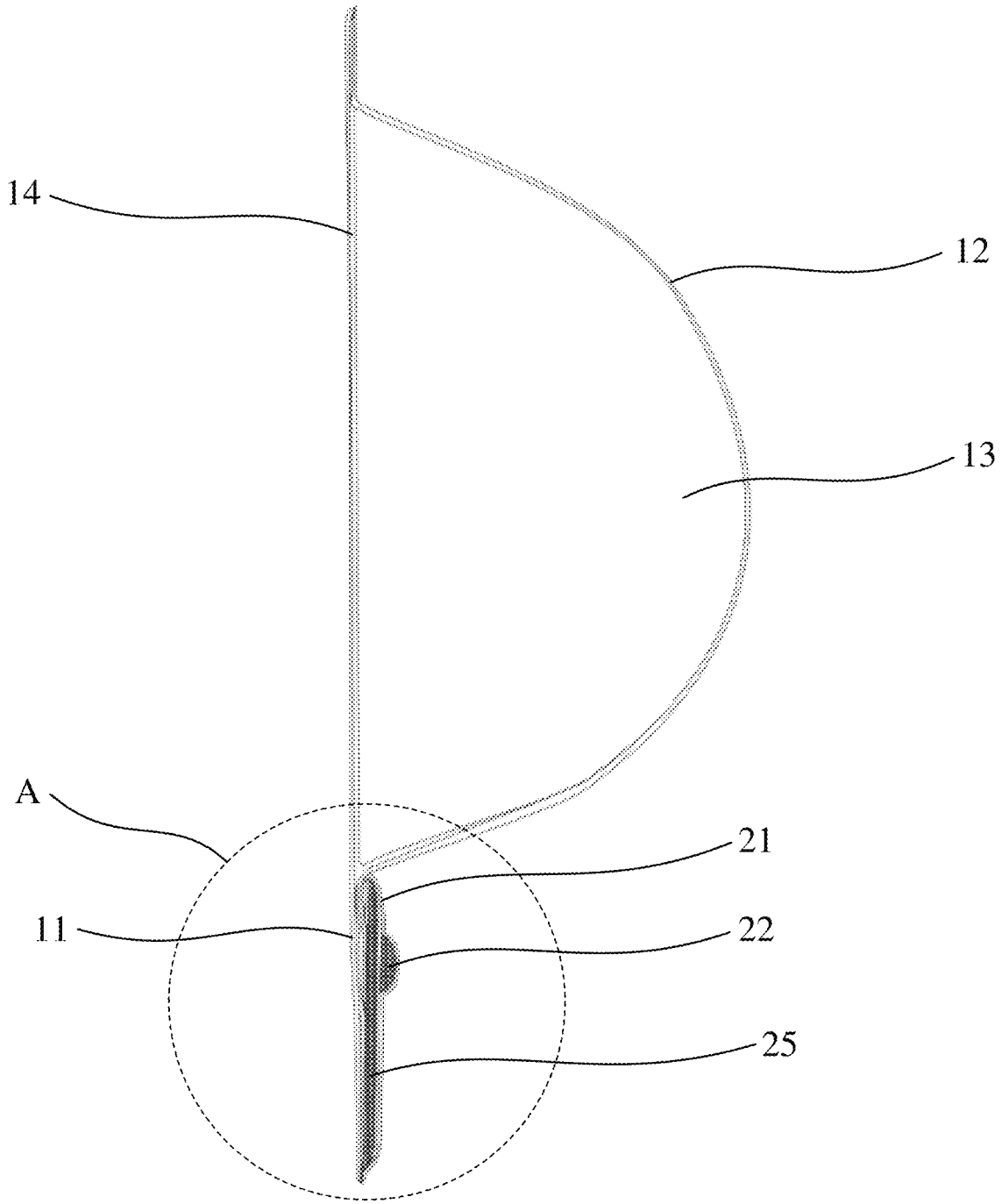
FIG. 2 is a schematic side view of layers of a brassiere and a lower supportive component according to some embodiments of the present application.
Figure 3:
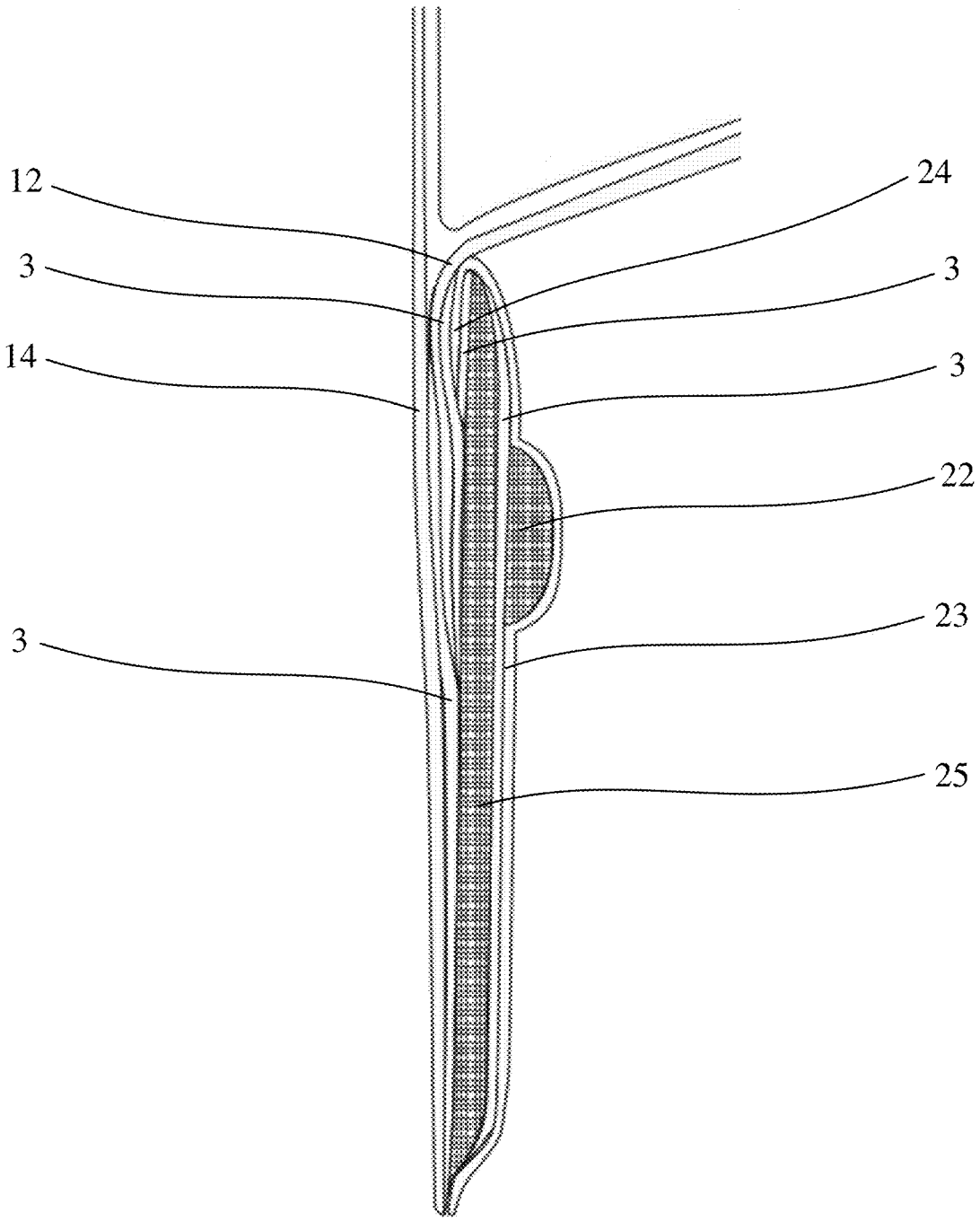
FIG. 3 is a schematic enlarged view at portion A in FIG. 2.

As shown in FIG. 1 to FIG. 3, a brassiere 100 is proposed in the present application. The brassiere 100 includes a bra cup 1 and a lower supportive component 2. The bra cup 1 includes a first connection part 11 configured to connect to the lower supportive component 2, the lower supportive component includes a second connection part 21 configured to connect to the bra cup 1, and the first connection part 11 and the second connection part 21 are stacked and connected. The first connection part 11 is embedded with a soft reinforcement strip 22; the second connection part 21 is embedded with the soft reinforcement strip 22; or the soft reinforcement strip 22 is provided between the first connection part 11 and the second connection part 21, and a toughness of the soft reinforcement strip 22 is higher than a toughness of the bra cup 1 and a toughness of other parts of the lower supportive component 2.

Specifically, the brassiere 100 includes a bra cup 1 and a lower supportive component 2. The lower supportive component 2 is connected to the lower edge of the bra cup 1. The lower edge of the bra cup 1 is provided with a first connection part 11. The lower supportive component 2 is provided with a second connection part 21. By stacking the first connection part 11 and the second connection part 21 together, the lower supportive component 2 is connected to the bra cup 1, and the lower supportive component 2 is used to provide support for the breast. A soft reinforcement strip 22 is provided at the stacked connection between the bra cup 1 and the lower supportive component 2. The toughness of the soft reinforcement strip 22 is higher than the toughness of the bra cup 1 and the toughness of other parts of the lower supportive component 2. The soft reinforcement strip 22 which can be a sandwich strip formed by stacking many different layering fabrics, have good elasticity, are not easily deformed, and can withstand strong tensile forces. Therefore, by adding a soft reinforcement strip 22, the brassiere 100 can provide good support for female breasts. In addition, the brassiere 100 is also provided with two shoulder straps 4. The two shoulder straps 4 are respectively connected to the two bra cups 1 for lifting the brassiere 100. As shown in FIG. 2, FIG. 2 is a lateral cross-sectional view of the brassiere 100 with the shoulder straps 4 removed, which can show the various hierarchical structures of the bra cup 1 and the lower supportive component 2 of the brassiere 100.

It is worth noting that the soft reinforcement strip 22 can be provided on the first connection part 11 of the bra cup 1, can also be provided on the second connection part 21 of the lower supportive component 2, or can also be provided between the first connection part 11 and the second connection part 21, as long as the soft reinforcement strip 22 can be fixed on the lower edge of the bra cup 1. The soft reinforcement strip 22 can be extended and arranged along the lower edge of the bra cup 1 to provide better support.

It should be understood that in the technical solution of the present invention, the soft reinforcement strip 22 is embedded, and the toughness of the soft reinforcement strip 22 is higher than the toughness of the bra cup 1 and the toughness of other parts of the lower supportive component 2, thereby providing good support. The soft reinforcement strip 22 embedded can enhance the support performance of the lower supportive component 2 to support the breasts well, and reduce breast sagging and deformation. In addition, the soft reinforcement strip 22 have a high fit with the lower edge of the human breast and have good comfort.

In some embodiments of the present application, the soft reinforcement strip 22 is bonded through a gluing process.

In detail, the soft reinforcement strip 22 can be fixed in a variety of ways, which can be directly connected through textiles or through gluing. In these embodiments, the soft reinforcement strip 22 are bonded through a gluing process, such that the soft reinforcement strip 22 can be tightly attached. The gluing process can better maintain the stability and integrity of the brassiere 100, and the use method is simpler.

In some embodiments of the present application, the second connection part 21 is embedded with the soft reinforcement strip 22, and the soft reinforcement strip 22 is provided on an inside layer of the lower supportive component 2.

It should be understood that in these embodiments, the soft reinforcement strip 22 is embedded in the second connection part 21 of the lower supportive component 2, and the lower supportive component 2 is connected to the lower edge of the bra cup 1. The soft reinforcement strip 22 can be configured to extend along the lower edge of the bra cup 1.

As shown in FIG. 1, the soft reinforcement strip 22 forms a whole around the bra cup 1, that is to say, the soft reinforcement strip 22 extends from the lower edge of the bra cup 1 to the side of the bra cup 1 which is the side of the main body of the brassiere 100. This arrangement makes the soft reinforcement strip 22 along the lower edge of the left and right bra cup 1 form a W shape, which acts as an upward support against the effect of gravity, stably lifting the breasts and fixing them in a reasonable position, thereby improving the wearing stability of the brassiere 100 and enhancing the supporting effect of the brassiere 100.

In some embodiments of the present application, the lower supportive component 2 includes an outer layer 23, the soft reinforcement strip 22 and an inner layer 24 which are stacked in sequence from an outside to an inside.

In detail, the lower supportive component 2 includes an outer layer 23, a soft reinforcement layer 25 and an inner layer 24. The soft reinforcement layer 25 is provided between the outer layer 23 and the inner layer 24. By arranging the fabric of the outer layer 23 and the fabric of the inner layer 24, the soft reinforcement strip 22 is better fixed to strengthen the support of the lower supportive component 2.

In some embodiments of the present application, the lower supportive component 2 further includes a soft reinforcement layer 25 located on the inside layer of the lower supportive component 2, and the outer layer 23, the soft reinforcement strip 22, the soft reinforcement layer 25 and the inner layer 24 are stacked in sequence.

Specifically, a soft reinforcement layer 25 is also embedded in the lower supportive component 2. The soft reinforcement layer 25 is provided between the soft reinforcement strip 22 and the fabric of the inner layer 24. By arranging the soft reinforcement layer 25 and the soft reinforcement strip 22 cooperatively, the supporting performance of the entire lower supportive component 2 is increased.

The soft reinforcement strip 22 is in the shape of a strip, and the soft reinforcement layer 25 is in the shape of a sheet. The soft reinforcement strip 22 is arranged along the lower edge of the bra cup 1. The soft reinforcement layer 25 is flush with the outer layer 23 and the inner layer 24. The soft reinforcement strip 22 can enhance the supporting performance of the lower supportive component 2, and the soft reinforcement layer 25 enhances the overall strength of the lower supportive component 2. The reinforcement layer composed of the two fitting with the lower edge of the human breast to a high degree and having good comfort, can provide better support for the breasts, thereby improving the load-bearing performance of the wire-free brassiere 100.

In some embodiments of the present application, the outer layer 23 and the soft reinforcement layer 25 are bonded through the gluing process, the soft reinforcement strip 22 is fixed between the outer layer 23 and the soft reinforcement layer 25, and the soft reinforcement layer 25 and the inner layer 24 are bonded through the gluing process.

In detail, the various fabric layers of the lower supportive component 2 are also bonded through the gluing process. The outer layer 23 and the soft reinforcement layer 25 are bonded through the gluing process, and the soft reinforcement strip 22 is fixed between the outer layer 23 and the soft reinforcement layer 25. Meanwhile, the soft reinforcement layer 25 and the inner layer 24 are also bonded through the gluing process, which can maintain the stability of the attachment of each fabric layer. Even though the attachment method is simple, the stability and integrity of the brassiere 100 can be better maintained.

In some embodiments of the present application, the soft reinforcement strip 22 is a fabric strip formed by laminating polyester filament, draw texturing yarn and polyester filament in sequence, and the soft reinforcement layer 25 is a fabric piece formed by laminating polyester filament, draw texturing yarn and polyester filament in sequence.

Specifically, the types of fabrics of the soft reinforcement strip 22 and the soft reinforcement layer 25 can be selected according to actual needs, and can be polyester staple fiber, monofilament with polyester staple fiber, cotton, monofilament with cotton, etc.

In these embodiments, the soft reinforcement strip 22 is a fabric strip formed by laminating polyester filament, draw texturing yarn and polyester filament in sequence, and the soft reinforcement layer 25 is a fabric piece formed by laminating polyester filament, draw texturing yarn and polyester filament in sequence. The soft reinforcement strip 22 and the soft reinforcement layer 25 can maintain a certain elongation rate without loosening and deforming, thereby providing support, meanwhile fitting the skin more comfortably.

In addition, in these embodiments, the fabrics of the outer layer 23 and the inner layer 24 are made of nylon cloth, which has good wear resistance, good elasticity, and straight characteristics, and can provide better supporting performance.

In some embodiments of the present application, an end of the outer layer 23 is configured to extend towards the inner layer 24 and fixedly connect to an end of the inner layer 24, thereby wrapping the soft reinforcement strip 22 and the soft reinforcement layer 25.

It is worth noting that one end of the outer layer 23 extends toward the direction of the inner layer 24 and is fixedly connected to the end of the inner layer 24, that is, the outer layer 23 can wrap the soft reinforcement strip 22 and the soft reinforcement layer 25. Through a hemming process, the soft reinforcement strip 22 and the soft reinforcement layer 25 is wrapped to enhance the aesthetics. In addition, by connecting the outer layer 23 and the inner layer 24, the integrity of the lower supportive component 2 is enhanced.

In these embodiments, the outer layer 23 and the inner layer 24 are made of the same fabric, and the outer layer 23 and the inner layer 24 are formed by folding the fabric in half.

In some embodiments of the present application, the bra cup 1 includes a first fabric layer 12, a cup surface layer 13 and a second fabric layer 14 which are stacked in sequence form an outside to an inside, and an outer side of the first fabric layer 12 and an inner side of the lower supportive component 2 are stacked together.

In detail, the bra cup 1 is also provided with three layers, from the outside to the inside, being the first fabric layer 12, the cup surface layer 13 and the second fabric layer 14. The lower edges of the first fabric layer 12 and the second fabric layer 14 extend towards the lower supportive component 2, and the extended portion forms a first connection part 11 for stacking and connecting with the lower supportive component 2 to form an integral supporting part.

That is to say, the lower supportive component 2 is spliced with the lower edge of the bra cup 1. Through the splicing design, the lower supportive component 2 forms a W-shaped support, which has the function of holding up the breasts. It can hold the breasts firmly and fix them in a reasonable position, thereby having a good supporting effect for the breasts.

In some embodiments of the present application, the second fabric layer 14 and the inner side of the lower supportive component 2 are bonded through the gluing process, the first fabric layer 12 and the second fabric layer 14 are bonded through the gluing process, and the cup surface layer 13 is fixed between the first fabric layer 12 and the second fabric layer 14.

In detail, the cup surface layer 13 of the bra cup 1 is disposed between the first fabric layer 12 and the second fabric layer 14. The cup surface layer 13 is sealed between the first fabric layer 12 and the second fabric layer 14 to fix the cup surface layer 13. The connection between the first fabric layer 12 and the second fabric layer 14 is also achieved through a gluing process. As shown in FIG. 3, each adhesive layer 3 of the gluing process is simple to be bonded, and each fabric layer can be attached more stably, which can better maintain the integrity of the brassiere 100.

The outer side of the first fabric layer 12 and the inner side of the lower supportive component 2 are bonded through the gluing process to connect the lower supportive component 2 and the extension of the bra cup 1 as a whole. The lower supportive component 2 and the extension of the lower edge of the bra cup 1 are overlapped and bonded through the gluing process. This overlapping structure also further strengthens the supporting performance of the lower supportive component 2.

It should be noted that the above are only some embodiments of the present application, and do not limit the scope of the present application thereto. Under the concept of the present application, equivalent structural transformations made according to the description and drawings of the present application, or direct/indirect application in other related technical fields are included in the scope of the present application.

What is claimed is:

1. A brassiere, comprising:

a bra cup; and a lower supportive component;

wherein the bra cup comprises an inner portion of the brassiere connected to the lower supportive component, and the lower supportive component comprises an outer portion of the brassiere connected to the bra cup; and the inner portion of the brassiere and the outer portion of the brassiere are stacked and connected;

wherein the outer portion of the brassiere is embedded with a soft reinforcement strip; and a toughness of the soft reinforcing strip is higher than a toughness of the bra cup and a toughness of other parts of the lower supportive component;

wherein the lower supportive component comprises an outer layer, the soft reinforcement strip, and an innermost layer which are stacked in sequence from an outside of the brassiere to an inside of the brassiere, wherein the lower supportive component further comprises a soft reinforcement layer located internal to the soft reinforcement strip, such that the outer layer, the soft reinforcement strip, the soft reinforcement layer and the innermost layer are stacked in sequence from the outside of the brassiere to the inside of the brassiere;

wherein the soft reinforcement strip is a fabric strip formed by laminating polyester filament, draw texturing yarn and polyester filament in sequence; and wherein the soft reinforcement layer is a fabric piece formed by laminating polyester filament, draw texturing yarn and polyester filament in sequence.

2. The brassiere according to claim 1, wherein the soft reinforcement strip is bonded through a gluing process.

3. The brassiere according to claim 1, wherein the outer layer and the soft reinforcement layer are bonded through a gluing process, the soft reinforcement strip is fixed between the outer layer and the soft reinforcement layer, and the soft reinforcement layer and the innermost layer are bonded through the gluing process.

4. The brassiere according to claim 1, wherein an end of the outer layer is configured to extend towards the innermost layer and fixedly connect to an end of the innermost layer to wrap the soft reinforcement strip and the soft reinforcement layer.

5. The brassiere according to claim 1, wherein the bra cup comprises a first fabric layer, a cup surface layer and a second fabric layer which are stacked in sequence from an outside to an inside, and an outer side of the first fabric layer and an inner side of the lower supportive component are stacked together.

6. The brassiere according to claim 5, wherein the second fabric layer and the inner side of the lower supportive component are bonded through a gluing process, the first fabric layer and the second fabric layer are bonded through the gluing process, and the cup surface layer is fixed between the first fabric layer and the second fabric layer.

* * * * *